United States Patent [19]

Tanaka et al.

[11] 4,316,937

[45] Feb. 23, 1982

[54] WATER ABSORBENT ACRYLIC FIBER

[75] Inventors: Hiroyoshi Tanaka; Shigeru Fujii; Mitsuo Suzuki, all of Ehime, Japan

[73] Assignee: Toray Industries, Inc., Tokyo, Japan

[21] Appl. No.: 119,677

[22] Filed: Feb. 8, 1980

Related U.S. Application Data

[63] Continuation of Ser. No. 1,399, Jan. 5, 1979, abandoned.

[30] Foreign Application Priority Data

Jan. 19, 1978 [JP] Japan ..... 53/4473

[51] Int. Cl.[3] ..... D02G 3/00

[52] U.S. Cl. ..... 428/376; 428/398

[58] Field of Search ..... 428/373, 374, 375, 376, 428/398; 264/182, 41; 260/881

[56] References Cited

U.S. PATENT DOCUMENTS

| | | | |
|---|---|---|---|
| 3,551,547 | 12/1970 | Knudsen | 264/182 |
| 3,577,499 | 5/1971 | Knudsen | 264/182 |
| 3,896,204 | 7/1975 | Goodman et al. | 264/182 X |
| 3,929,946 | 12/1975 | Orito et al. | 264/182 X |
| 3,957,936 | 5/1976 | Lauchenauer | 428/376 X |
| 3,984,515 | 10/1976 | Mommaerts | 428/376 X |
| 3,984,601 | 10/1976 | Blickenstaff | 428/376 X |
| 4,007,248 | 2/1977 | Kostadinov | 264/182 |
| 4,012,459 | 3/1977 | Takeya et al. | 264/182 X |

*Primary Examiner*—Lorraine T. Kendell

*Attorney, Agent, or Firm*—Austin R. Miller

[57] ABSTRACT

The present invention relates to an acrylic fiber having excellent water absorbency. The fiber has a porous core and a relatively dense skin structure. It is a blended polymer which comprises an acrylic polymer copolymerized with a synthetic polymer which is miscible but substantially incompatible therewith, and is soluble in a solvent for the acrylic polymer but is insoluble in water.

6 Claims, 4 Drawing Figures

WATER ABSORBENT ACRYLIC FIBER

This is a continuation of application Ser. No. 1,399 filed Jan. 5, 1979, now abandoned.

FIELD OF THE INVENTION

The present invention relates to an acrylic fiber having excellent water absorbency and good mechanical properties for blending into fibrous products.

DISCUSSION OF THE PRIOR ART

Synthetic fibers are generally lacking in moisture or water absorbency. Only rarely are they used alone and without blending with other fibers for making fabrics such as underwear, summer clothing, sheets, towels, bedclothes and the like. For these purposes, synthetic fibers are usually blended with various natural fibers including cellulose fibers such as cotton, hemp or rayon, for example.

In order to improve the moisture absorbency of synthetic fibers, various methods have heretofore been proposed. It has heretofore been proposed to produce a fiber having a skin-core structure in which the core is porous and the skin is relatively dense. Such a product has been formed as a part of the process of producing acrylic fibers. It involves wet spinning and drying at a relatively low temperature without collapsing the porous structure of the coagulated fiber.

However, water absorbent acrylic fibers having such skin-core structures are difficult to produce, because the porous structure formed by the wet spinning and coagulating process is in the form of a swollen gel. Accordingly, it is very unstable during the after-treatment process steps, especially during the drying and heat-setting steps. Accordingly, the water absorption properties of the product vary considerably under different conditions of drying and heat setting.

OBJECTS OF THE INVENTION

One of the objects of the present invention is to provide an acrylic fiber having excellent and stable water absorbency and having other fiber properties which are also stable.

Another object of the present invention is to provide a process for preparing an acrylic fiber having excellent water absorbency which also has stable water absorbency, and wherein the fibers experience little or no change or deterioration during the fiber production process.

Another object is to produce a fiber having these attributes together with stable fiber properties.

Still another object of the present invention is to provide a water absorbent fiber which has a porous core structure and a relatively dense skin, and which has excellent heat resistance.

Other objects of the present invention, including the adaptability and economy of the process and of the product, will appear in further detail hereinafter.

SUMMARY OF THE INVENTION

In accordance with the present invention, an acrylic fiber is produced which has a structure consisting of a porous core containing numerous microvoids and macrovoids, covered by a relatively dense skin layer. This highly advantageous result is achieved by using in the production process a polymer blend containing a major amount of an acrylic polymer (A) and a minor amount of a selected synthetic polymer (B) which is miscible with but substantially incompatible with the principal acrylic polymer, and which is soluble in a solvent for the acrylic polymer but substantially insoluble in water.

BRIEF DESCRIPTION OF THE DRAWINGS

FIG. 1 is a view in cross section of a group of conventional acrylic fibers having a fine porous structure, and FIG. 2 is also a view in cross section, highly magnified, of a portion of a single known water absorbent acrylic fiber, showing the regular arrangement of fine pores.

FIG. 3 represents a cross section of a group of fibers and

FIG. 4 is also a view in cross section, highly magnified, of a portion of a single fiber obtained in accordance with one example of the present invention.

DETAILED DESCRIPTION OF THE INVENTION

Figure 1:
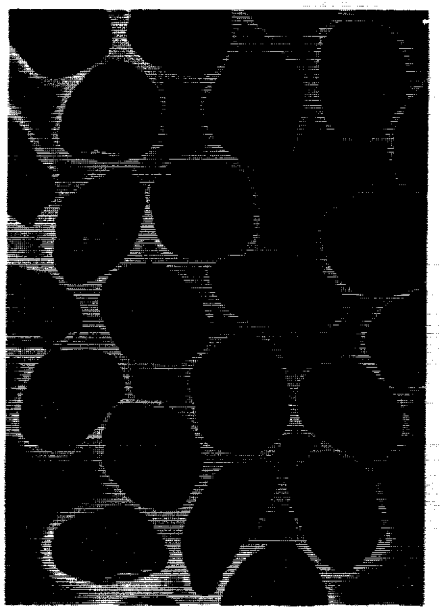
FIGS. 1 and 2 of the drawings are electron microscopic photographs of fibers.

The major component (A) of the water absorbent fiber of the present invention is an acrylic polymer. This expression, as used herein, is not limited to acrylonitrile polymers per se but also includes various copolymers consisting of acrylonitrile (AN) and one or more comonomers copolymerizable with AN. Examples of these comonomers in component (A) include acrylic acid, methacrylic acid, itaconic acid and lower alkyl esters or ammonium salts of any of the foregoing, and mixtures thereof. The group comprising the comonomer utilized in component (A) includes monoethylenic vinyl monomers such as vinyl acetate, vinyl chloride, styrene, α-methyl styrene, vinyl monomers containing a sulfonic acid group such as allyl sulfonic acid, methallyl sulfonic acid, vinylbenzene sulfonic acid, and alkali metal or ammonium salts thereof, for example.

Copolymerization ratio of the comonomer (A) based upon the weight of the polymer produced is about 0–10 mol %, preferably about 0–5 mol %, more preferably about 0–4.5 mol % of the above-mentioned monoethylenic vinyl monomers and about 0–0.3 mol %, preferably about 0–0.2 mol %, of the above-mentioned vinyl monomers containing a sulfonic acid group.

Copolymerization of the monoethylenic monomers with the acrylic component, to form the component (A) in the proportions set forth herein, increases the solubility of the product (A) in solvents, improves the stability of the spinning solutions, and enhances the spinning processability of the resulting acrylonitrile copolymer. However, when the aforesaid copolymerization ratio exceeds about 10 mol %, the porous structure to be formed in the coagulation process unfavorably tends to collapse rather easily, due to the compactness of the fiber that results from the drying process.

Copolymerization of AN using a vinyl monomer containing a sulfonic acid group improves the dye affinity of the fiber. However, when the copolymerization ratio exceeds about 0.3 mol %, the formation of the porous structure in the coagulation process is suppressed. Also, the porous structure tends to collapse easily upon stretching and drying. Under such circumstances, it is difficult to obtain a fiber having sufficient water absorbency.

It has been discovered in accordance with this invention that a variety of synthetic polymers (B) may be blended with the above-mentioned acrylic polymers with unexpected advantage. The synthetic polymer (B) must be miscible but substantially incompatible with the acrylic polymers of this invention and must be soluble in solvents for the acrylic polymer but essentially insoluble in water.

When the synthetic polymer (B) utilized in the present invention is not miscible with the acrylic polymers (A) or is insoluble in the solvent used for the acrylic polymer (A), stable spinning solutions having good processability cannot be obtained. Also, fibers having satisfactory properties for practical use cannot be obtained because of poor stretchability of the coagulated fibers.

While polymers (A) and (B) generally do not copolymerize with each other, they may possibly be copolymerized by the use of a particular polymerization method. Although polymers made from condensation polymerization do copolymerize with each other, polymers made from additional polymerization usually do not copolymerize with each other. Thus, where the expression "substantially incompatible with" is used with respect to the synthetic polymer (B) and the acrylic polymer (A), this expression usually means that they are not copolymerized at all, but in some cases, some copolymerization may be effected in the process of this invention.

It is important for the synthetic polymer (B) of the present invention to be substantially incompatible with the acrylic polymer (A). When the synthetic polymer (B) is compatible with the acrylic polymer (A), it is difficult to form voids having a diameter of 0.5–2$\mu$ in the core having the porous structure. Further, it is essentially impossible to obtain adequate water absorbing properties. It is undesirable for the synthetic polymers (B) of the present invention to be soluble in water, because the synthetic polymers (B) would dissolve into the solution in the coagulating bath or in the draw bath, where aqueous solutions are usually used in the wet spinning of acrylic fibers. This is also true because the durability of the product after extended or repeated contact with water is adversely affected. Organic solvents may be used for component (B) such as dimethyl sulfoxide (DMSO), dimethyl formamide (DMF), or dimethyl acetamide (DMAc). These function suitably for various copolymers such as, AN-styrene copolymers, AN-styrene derivatives such as $\alpha$-methyl styrene copolymers, cellulose acetate, and polymethylmethacrylate, for example.

AN-styrene copolymers, which are preferably used as component (B) in accordance with this invention, include those (i) consisting of about 20–30% by weight of AN and about 70–80% by weight of styrene.

The softening point of the synthetic polymer (B) is about 100°–250° C., preferably about 100°–150° C. This gives high heat resistance to the resulting absorbent acrylic fiber.

The synthetic polymer (B) may be blended with the acrylic polymer (A) as a blend polymer comprising more than about 90%, preferably about 90–99.9% by weight of the acrylic polymer (A) and less than about 10%, preferably about 0.01–10% by weight of the synthetic polymer (B). Outside of this range, product stability and spinning processability deteriorate, and it is impossible to obtain commercially satisfactory spinnability or to produce a fiber having commercially acceptable properties. The solvents for the acrylic polymers include inorganic solvents such as concentrated nitric acid, aqueous solutions of zinc chloride or sodium thiocyanate or the above-mentioned organic solvents. However, an organic solvent is preferably selected by considering the miscibility of the synthetic polymer (B) with the acrylic polymer (A) and the solubility of the synthetic polymer (B) in the solvent.

The spinning solution comprises an organic solvent containing the above-mentioned acrylic polymer and the synthetic polymer. In order to produce a water absorbent acrylic fiber, one may use any known wet spinning method which includes the steps of drawing, stretching, washing, oiling and drying.

As a typical example, the following comments apply to conditions utilized in the set spinning method when an organic solvent is used.

Referring now to the coagulating conditions, the temperature of the coagulating bath is about 30°–70° C., preferably about 35°–55° C. With the use of a lower temperature, the formation of the voids is insufficient and with the use of a higher temperature, the product is difficult to take up because of yarn breakage.

Referring now to the temperature of the coagulating bath, the higher the temperature, the easier it is to form the desired porous structure. The higher the temperature, the more brittle the tensile properties of the fibers become.

It is possible to obtain water-absorbing properties by setting the spinning draft to a high level or by setting the concentration of the spinning solution at a low level, when the temperature of the coagulating bath is 30°–50° C.

From the viewpoint of tenacity and elongation, it is desirable to set the spinning draft at a high level and the temperature of the coagulating bath relatively low.

The resulting as-spun yarn is usually stretched to at least about five times its as-spun length. It is favorable to perform a wet heat treatment on the fiber by use of hot water or steam in order to stabilize the structure of the stretched yarn before drying.

The drying conditions should be controlled with care. When the drying temperature is too high, the porous structure of the fiber tends to disappear during drying and the water absorbency of the fiber deteriorates. On the other hand, when the drying temperature is too low, productivity deteriorates and the water absorbency of the fiber tends to vary in the spinning and weaving of the fiber and in subsequent heating during the use of the fabric manufactured from the fibrous product. Accordingly, it is preferred to dry at a temperature of at least about 100° C., preferably about 120°–170° C.

In accordance with this invention, a filament is formed having a substantially porous core structure and having a skin formed over the core. Examples of structures produced in accordance with this invention appear in the drawings.

Figure 2:
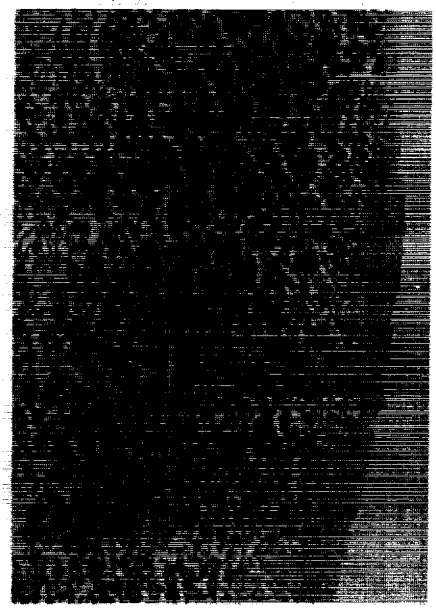

Referring to FIG. 1 of the drawings, a plurality of filaments appear in cross section. These are conventional acrylic fibers or filaments. As appears in FIG. 2, which is a much more highly magnified photomicrograph of one of the fibers or filaments of FIG. 1, it is seen that the structure includes an orderly arrangement of rather fine pores extending substantially throughout the cross section of the fiber or filament.

Figure 3:
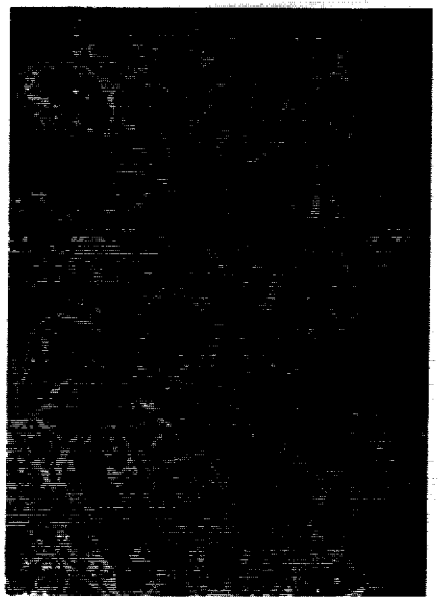
FIGS. 3 and 4 of the drawings are electron microscopic photographs of fibers in accordance with this invention.
Figure 4:
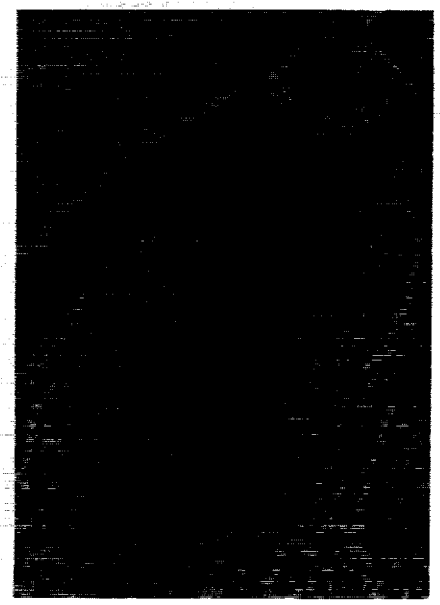

By way of contrast, FIG. 3 is a view in cross section, similar to FIG. 1, but showing the highly porous structure of the core portions of the fibers or filaments in accordance with this invention. Referring particularly to FIG. 4, highly irregular pores may be observed within the core portion of the fiber or filament, and a well-formed and highly structured skin is arranged substantially continuously along the surface of the fiber or filament.

Ordinarily, when an acrylic polymer solution is spun into a coagulation bath, it coagulates as a result of diffusion between a coagulant such as water and the solvent in the acrylic polymer solution. According to the phase equilibrium existing between the polymer, the solvent and the coagulant, the polymer tightly coagulates, fibrils are formed and voids are concurrently formed around the fibrils. In the event that a difference is created between the coagulation conditions existing at the inner portion of the yarn and those existing at the outer portion of the yarn, caused by the limitations with respect to the diffusion rate of the coagulant, a skin-core structure can be produced.

It is known that it is possible to form voids as soon as the filament is spun out of the spinneret during the coagulation process. However, the voids thus formed readily disappear when the yarn passes through the usual drawing, drying and heat-setting steps.

By way of contrast, in the process according to this invention wherein the polymers (A) and (B) are mixed with each other, the voids surprisingly remain stable even after passing through the usual drawing, drying and heat-setting steps.

Since the polymers (A) and (B) of this invention work quite differently with respect to the coagulant, during the coagulation step, each of the coagulated structures also is differently formed.

For example, when the polymer (A) is an acrylic polymer and when the polymer (B) is an acrylonitrile-styrene resin, the polymer (A) forms microvoids and the presence of polymer (B) causes the formation of macrovoids in polymer (A). Accordingly, the resulting fiber highly surprisingly contains a mixture of microvoids and macrovoids, and this surprisingly results in a fiber having excellent water absorbency.

On the other hand, since polymers (A) and (B) are miscible and are mixed uniformly in the spinning solution at the time of coagulation, the polymers (A) and (B) do not distribute themselves selectively over the skin or the core. Accordingly, the ratio of polymer components (A) and (B) in the skin and core are virtually the same.

Water retention may be measured by the method reported by V. Zarz in *Melliand Textile Berichte* 34,849 (1953). This is the procedure that was used in the examples which appear hereinafter. The fiber to be tested for water retention (or water absorbency) was cut to a staple length of about 50 mm., carded and dipped into water for 10 minutes. The wet fiber was placed in a basket and centrifuged at 400 g. for 5 minutes and dried at 100° C. Water retention (WR) was calculated by Equation 1:

$$WR(\%) = 100(A - B)/B \quad (1)$$

where A represented the weight of the moist fiber after centrifuging at 400 g for 5 minutes, and B represented the weight of the dried fiber.

The following examples are illustrative of the practice of the invention. They are not intended to limit the scope of the invention, which is defined in the appended claims.

EXAMPLE 1

A spinning solution of a copolymer of AN, methylacrylate (MEA) and sodium metharyl sulfonate (SMAS) was prepared by solution polymerization in DMSO. The composition of the copolymer was 95.85 mol % of AN, 4.0 mol % of MEA and 0.15 mol % of SMAS and the polymer content of this polymer solution was 20% by weight.

Further, various additives which are shown in Table 1 were dissolved in DMSO and the resulting solution was mixed with the above-mentioned polymer solution. In each case, the amount of the additives was 3% by weight, based upon the weight of the acrylic polymer. Each spinning solution was extruded through a spinneret having capillaries each having a diameter of 0.065 mm., and the fibrous product was solidified in a 50% by weight aqueous solution of DMSO at 55° C. and drawn at a draw ratio of 6. Each fiber was dried for 15 minutes at 130° C., after washing with water. The tenacity, elongation and water retention of the resulting fibers are shown in Table 1.

These tests show that where the heat-resisting and void-stabilizing additives of this invention were present, the resulting fibers had excellent water-absorbing properties.

TABLE 1

| Additive | Water Retention (%) | PRODUCT Tenacity (g/d) | Elongation (%) |
|---|---|---|---|
| Cellulose acetate (acetic acid content 55% by weight) | 49 | 2.3 | 18.4 |
| AS resin (AN/ST 24/76 wt %) | 54 | 2.5 | 17.2 |
| Polyethylene glycol (MW: 100) | 7 | 2.7 | 20.5 |
| Polyethylene glycol (MW: 4200) | 7 | 2.6 | 19.8 |
| Polyvinyl acetate | 12 | 2.3 | 16.9 |
| Polyoxyethyleneoxytetramethylene glycol (MW: 1800) | 18 | 2.5 | 17.8 |
| Polyvinyl pyrrolidone | 7 | 2.8 | 20.1 |
| Control (no additive) | 7 | 2.9 | 22.1 |

EXAMPLE 2

The mixed polymer solution comprising acrylic polymer solution and AS resin obtained according to the procedure of Example 1 (line 2, Table 1) was extruded into a 50% aqueous DMSO solution, and the spinning draft and temperature of the coagulation bath were varied as indicated in Table 2.

The as-spun yarn were drawn at a ratio of 7, washed with water, and dried at 170° C., with 10% relaxation. The physical properties of the resulting fibers are shown in Table 2.

From Table 2 it should be understood that the water retention of the fiber increases with increase in spinning draft and with rise in the bath temperature. Spinning at a high draft ratio and with a relatively lower temperature favorably affected the tenacity and elongation characteristic of the fiber product.

TABLE 2

| Spinning Draft | Coagulation Temperature (%) | Water Retention (%) | Tenacity (g/d) | Elongation (%) |
|---|---|---|---|---|
| 0.52 | 15 | 7 | 2.8 | 23.0 |
| " | 30 | 10 | 2.9 | 22.8 |

TABLE 2-continued

| Spinning Draft | Coagulation Temperature (%) | Water Retention (%) | Tenacity (g/d) | Elongation (%) |
|---|---|---|---|---|
| " | 40 | 20 | 2.7 | 18.8 |
| " | 45 | 35 | 2.5 | 17.5 |
| " | 50 | 45 | 2.3 | 18.2 |
| " | 55 | 57 | 2.2 | 18.5 |
| " | 60 | 63 | 2.3 | 17.0 |
| 0.89 | 30 | 24 | 3.5 | 18.7 |
| " | 40 | 33 | 3.2 | 20.1 |
| " | 50 | 51 | 2.8 | 19.8 |
| 1.05 | 30 | 29 | 3.5 | 18.9 |
| " | 40 | 39 | 3.0 | 19.7 |
| " | 50 | 55 | 2.7 | 18.6 |

EXAMPLE 3

A DMSO solution of copolymer composed of 96.9 mol % of AN, 3 mol % of MEA, and 0.1 mol % of sodium allylsulfonate (SAS) was prepared by solution polymerization in DMSO.

The polymer concentration of the resulting polymer solution was 22%. AS resin, as used in Example 1, was mixed with the aforesaid polymer solution and tests were conducted by varying the ratio of AS resin to the acrylic polymer.

Each mixed polymer solution was spun into a 50% aqueous DMSO solution at a temperature of 65° C., was drawn at a draw ratio of 6, and was washed with water and dried at 130° C. The spinnability and physical properties of each resulting fiber are shown in Table 3.

TABLE 3

| AS Resin Content (%) | Spinnability | Water Retention (%) | Tenacity (g/d) | Elongation (%) |
|---|---|---|---|---|
| — | good | 7 | 2.9 | 27.0 |
| 0.2 | " | 22 | 2.7 | 25.0 |
| 0.5 | " | 35 | 2.5 | 24.1 |
| 1.0 | " | 45 | 2.3 | 23.2 |
| 3.0 | " | 62 | 2.1 | 21.2 |
| 8.0 | " | 71 | 2.1 | 23.0 |
| 11.0 | poor* | 85 | 1.8 | 19.7 |

*It was difficult to obtain commercial spinnability because of yarn breakage.

EXAMPLE 4

Each acrylic polymer solution, varying the acrylic polymer composition as indicated in Table 4, was polymerized in DMSO. The characteristics of each spinning solution were controlled as follows:

The polymer concentration was 22% by weight and the solution viscosity was held at 200 poises/45° C., by the addition of dodecylmercaptan and by varying the amount of dodecylmercaptan present. AS resin made of 28 weight % of AN, 11 weight % of sytrene and 62 weight % of α-methylstyrene was mixed with each acrylic polymer solution. At this time the ratio of AS resin to the acrylic polymer was 2% by weight. Each mixed polymer solution was spin into a 50% aqueous DMSO solution at a temperature of 50° C., was drawn in boiling water at a draw ratio of 6, was washed with water and then steamed with relaxation and dried at 130° C. The water retention of the resulting fiber is shown in Table 4. The lower content of SAS and MEA favorably affected the increase of water retention.

TABLE 4

| AN/MEA/SAS (mol %) | | | Water Retention (%) |
|---|---|---|---|
| 96.0 | 4.0 | 0 | 75 |
| 95.9 | " | 0.1 | 61 |
| 95.8 | " | 0.2 | 43 |
| 95.7 | " | 0.3 | 22 |
| 95.5 | " | 0.5 | 15 |
| 94.0 | " | 1.0 | 7 |
| 99.8 | 0 | 0.2 | 51 |
| 97.8 | 2.0 | " | 47 |
| 93.8 | 6.0 | " | 38 |
| 91.8 | 8.0 | " | 32 |
| 87.8 | 12.0 | " | 28 |

In the foregoing description of this invention and the manner in which it may be performed, specific terms have been used in the interest of clarity, and specific examples have also been considered with respect to the structures of the fibers or filaments produced. However, it will be appreciated that many variations may be made in the process, in the relative proportions of the ingredients, and in the actual composition and structure of the resulting fibers or filaments, all without departing from the spirit or scope of this invention.

For example, although it is highly desirable to spin into a 50% DMSO solution as a solvent, various other solutions may be used instead. However, in spinning into a solution having a higher DMSO content, for example 85%, it is difficult to obtain polymer coagulation. On the other hand, in spinning into a DMSO solution having a much lower DMSO content, it is necessary to supply a large amount of water into the coagulation bath to control the amount of DMSO which accompanies the polymer solution when spinning. This, accordingly, requires unnecessary additional steps such as adjustment of bath concentration, recovery of the solvent, etc. For these reasons, the preferred content of DMSO in the solution is about 40–70% by weight.

Other variations in conjunction with the process steps, including adjustment of bath concentrations, temperatures and operating conditions, can also be made without departing from the spirit or scope of this invention as defined in the appended claims.

What we claim is:

1. A water absorbent acrylic fiber having a porous core and a skin structure which is denser than said core, comprising a blended polymer which comprises about 90–99.9% by weight of an acrylic polymer co-blended with about 0.01–10% by weight of acrylonitrile-styrene copolymer which is miscible with but substantially incompatible with said acrylic polymer, said acrylonitrile-styrene copolymer (B) being a copolymer consisting of about 20–30% by weight of acrylonitrile and about 70–80% by weight of styrene, and said acrylic polymer being an acrylonitrile polymer comprising about 90–100 mol% of acrylonitrile, 0–10 mol% of an ethylenically unsaturated comonomer and about 0–0.3 mol% of a monoethylenic vinyl monomer containing sulfonic acid group, said fiber containing a mixture of microvoids and macrovoids.

2. A water absorbent acrylic fiber according to claim 1, wherein said blended polymer comprises about 92–99% by weight of said acrylic polymer and about 8–0.1% by weight of said acrylonitrile-styrene copolymer.

3. A water absorbent acrylic fiber according to claim 1, wherein said core contains a multiplicity of voids, said voids having diameters of about 0.5-2 microns.

4. A water absorbent acrylic fiber according to claim 1, wherein said monoethylenic vinyl monomer containing a sulfonic acid group is a monomer selected from the group consisting of allyl sulfonic acid, methallyl sulfonic acid, styrene sulfonic acid, the alkali metal salts thereof, the ammonium salts or mixtures thereof.

5. The fiber defined in claim 1, wherein said acrylic polymer is selected from the group consisting of (1) acrylonitrile and (2) copolymers of acrylonitrile with polymers selected from the group consisting of acrylic acid, methacrylic acid, itaconic acid, the lower alkyl esters thereof, the ammonium salts thereof or mixtures thereof.

6. The fiber defined in claim 1, wherein said monoethylenic vinyl monomer is selected from the group consisting of vinyl acetate, vinyl chloride, styrene, α-methyl styrene, vinyl monomers containing a sulfonic acid group, allyl sulfonic acid, methallyl sulfonic acid, vinylbenzene sulfonic acid, the alkali metal salts thereof, or the ammonium salts thereof.

* * * * *